US010220230B2

(12) United States Patent
Gueret et al.

(10) Patent No.: US 10,220,230 B2
(45) Date of Patent: Mar. 5, 2019

(54) MITIGATION OF VAPOR CLOUD EXPLOSION BY CHEMICAL INHIBITION

(71) Applicant: TOTAL RAFFINAGE CHIMIE, Courbevoie (FR)

(72) Inventors: Christophe Gueret, Saint Romain en Gal (FR); Dirk Roosendans, Deinze (BE); Leopold Hoorelbeke, Liege (BE); Gilles Helschger, Le Havre (FR)

(73) Assignee: TOTAL RAFFINAGE CHIMIE, Courbevoie (FR)

( * ) Notice: Subject to any disclaimer, the term of this patent is extended or adjusted under 35 U.S.C. 154(b) by 335 days.

(21) Appl. No.: 14/433,404

(22) PCT Filed: Nov. 12, 2013

(86) PCT No.: PCT/EP2013/073652
§ 371 (c)(1),
(2) Date: Apr. 3, 2015

(87) PCT Pub. No.: WO2014/076097
PCT Pub. Date: May 22, 2014

(65) Prior Publication Data

US 2015/0238791 A1 Aug. 27, 2015

(30) Foreign Application Priority Data

Nov. 14, 2012 (EP) ..... 12306413

(51) Int. Cl.
*A62C 37/36* (2006.01)
*A62C 3/06* (2006.01)
(Continued)

(52) U.S. Cl.
CPC ..... *A62C 37/36* (2013.01); *A62C 3/06* (2013.01); *A62C 99/0009* (2013.01); *A62C 4/00* (2013.01)

(58) Field of Classification Search
CPC ..... A62C 37/36; A62C 3/06; A62C 99/0009; A62C 4/00
(Continued)

(56) References Cited

U.S. PATENT DOCUMENTS 4,268,460 A * 5/1981 Boiarski ..... A61M 11/06 128/200.16
4,578,102 A * 3/1986 Colmon ..... B05B 7/0416 65/114
(Continued)

FOREIGN PATENT DOCUMENTS

| | | |
|---|---|---|
| DE | 1 127 812 B | 4/1962 |
| EP | 2 153 872 A1 | 2/2010 |
| GB | 2 029 215 A | 3/1980 |

OTHER PUBLICATIONS

Chinese Office Action issued in corresponding Chinese Patent Application No. 201380059658.3 dated Jan. 3, 2017.
(Continued)

*Primary Examiner* — Chee-Chong Lee
(74) *Attorney, Agent, or Firm* — Sughrue Mion, PLLC

(57) ABSTRACT

A method to mitigate the consequences of a vapor cloud explosion due to an accidental release of a flammable gas in an open area, comprising: defining an hazardous area wherein an accidental release of flammable gas is likely to happen; receiving a signal from a detector device able to detect the presence of the flammable gas within the hazardous area, upon reception of a signal indicating the presence of the flammable gas within the hazardous area, generating a control signal to activate a release of a flame acceleration suppression product in the hazardous area, at a rate that is determined as a function of the volume of said hazardous area.

17 Claims, 2 Drawing Sheets

(51) Int. Cl.
*A62C 99/00* (2010.01)
*A62C 4/00* (2006.01)

(58) Field of Classification Search
USPC ..... 169/45
See application file for complete search history.

(56) References Cited

U.S. PATENT DOCUMENTS 4,655,395 A * 4/1987 Cioffi ..... B05B 1/265 239/427
4,734,451 A * 3/1988 Smith ..... B05B 7/1486 118/300
4,872,511 A * 10/1989 Davis ..... A62C 5/008 169/12
5,014,790 A * 5/1991 Papavergos ..... A62C 5/024 169/14
5,205,648 A * 4/1993 Fissenko ..... B01F 3/0807 137/3
5,211,336 A * 5/1993 Kaidonis ..... A62C 3/0292 169/43
2012/0312564 A1* 12/2012 Seliverstov ..... A62C 3/065 169/46

OTHER PUBLICATIONS

International Search Report for PCT/EP2013/073652 dated May 13, 2014.

* cited by examiner

MITIGATION OF VAPOR CLOUD EXPLOSION BY CHEMICAL INHIBITION

CROSS REFERENCE TO RELATED APPLICATIONS

This application is a National Stage of International Application No. PCT/EP2013/073652 filed Nov. 12, 2013, claiming priority based on European Patent Application No. 12 306 413.1 filed Nov. 14, 2012, the contents of all of which are incorporated herein by reference in their entirety.

The present invention relates to a method to mitigate the consequences of an unconfined or partially confined vapor cloud explosion by inhibition.

A particular hazard for petrochemical plants and refineries is an accidental release of a large quantity of flammable material resulting in the formation of a flammable cloud within the installation. Historical evidence has shown that the ignition of such a cloud can lead to a devastating explosion and a destruction of the installation. Such accidents are commonly named "Vapor Cloud Explosions" (VCE) or "unconfined vapor cloud explosion" and referred as "VCE".

Flame inhibition refers to a weakening of a flame, that is, a lowering of the overall exothermic reaction rate in the flame. This weakening may or may not lead to extinguishment, depending upon the flow field in which the flame exists.

This is different from fire suppression, flame extinguishment, or flame extinction which are often used to refer to the case in which the flame has been weakened to the point where it can no longer stabilize in the relevant flow field. Flame quenching refers to flame extinguishment for which heat losses to a surface was the precipitating factor.

Inhibition can be achieved by chemical interaction (by an inhibitor) or by cooling (for instance with water).

More precisely, the present invention concerns inhibition of an accelerating flame by a chemical interaction. The aim is to block the flame acceleration so that the maximum overpressures resulting from the VCE are lowered.

Indeed, the devastating potential of a VCE comes from the acceleration of the flame through the unburnt cloud. The higher the flame speed the higher the overpressure. Under certain circumstances the deflagration can undergo a DDT (Deflagration to Detonation Transition).

WO 2010/010044 describes a method comprising introducing a product in the cloud that will avoid acceleration of the flame. This is not a flame extinguishment nor a flame suppression. The result is that the flammable cloud is transformed into a mixture of flammable product, air and flame acceleration suppression product. In case of ignition the maximum potential effect is reduced from a VCE into a "bad" burning flash fire. It means that in case of ignition the flammable gas burns without explosion. An advantage is that the flammable gas has disappeared.

There is a need for a method providing more reliable results.

There is provided a method to mitigate the consequences of a vapor cloud explosion due to an accidental release of a flammable gas in an open area, comprising:

- defining an hazardous area wherein an accidental release of flammable gas is likely to happen;
- providing a plurality of detector devices within the hazardous area, each detector device being able to detect the presence of the flammable gas.

Advantageously, upon detection of the presence of the flammable gas within the hazardous area, the method may comprise generating a control signal to activate a release of a flame acceleration suppression product in the defined hazardous area, and transmitting the control signal toward release means.

The released amount of inhibitor may be sufficient to transform a flammable cloud into a mixture of flammable gas, air and said flame acceleration suppression product so as to prevent flame acceleration and eventually to let the flammable gas burn in case of ignition.

This method may allow detecting relatively small flammable clouds, which may avoid a large amount of flammable gas to burn. In particular, if a large amount, e.g. more than 100 kg, of hydrocarbons burns, there is a risk that the surrounding equipment be damaged. The method according to an embodiment of the present invention is therefore relatively reliable since the release of flame acceleration suppression may occur before the cloud is too large.

Providing a plurality of detector devices may allow forming a grid having a fineness such that it is possible to detect the presence of the flammable gas with a relatively high likelihood, and/or relatively rapidly.

Advantageously, the control signal to activate a release of a flame acceleration suppression product in the defined hazardous area may be generated and transmitted towards release means only if a number of detector devices, comprising at least two detector devices, advantageously three detector devices or more, detect the presence of the flammable gas within the hazardous area.

Using several detectors may allow avoiding the release of powder in case a detector has defaults and erroneously detects the presence of flammable gas.

The fineness of the grid may allow establishing a relatively reliable voting to activate a release of the flame acceleration suppression product.

In this embodiment, if a single detector device detects the presence of the flammable gas, e.g. by measuring a concentration of the flammable gas that is above a predetermined threshold, no flame acceleration suppression product is released. That is, the release is triggered only after the presence of a flammable cloud is proved by at least two detector devices, advantageously three detector devices in the same area.

Advantageously, the generated control signal may be such that the release takes place continuously (within a single shot), i.e., without interruptions.

It is advantageous that the flame acceleration suppression product remains airborne in the cloud as long as the risk of a VCE is possible.

The release speed may have a same value, e.g. 2 kg per second and per nozzle, during the whole release, or not.

Advantageously, the control signal is generated only if the at least two detector devices that detect the presence of the flammable gas are adjacent.

Indeed, detection by at least two detector devices that are relatively far away from each other may be due to another cause than a release of a flammable cloud within the hazardous area which could generate a VCE, e.g. a detector that has defaults and erroneously detects flammable gas or a purge of an equipment by an operator in one part of the unit. Detection by two detectors that are side by side is more likely to be due to a reliable flammable gas release.

More generally, providing a plurality of detectors and monitoring if a number of side-by-side detectors may allow obtaining a relatively reliable representation of the flammable cloud, thus allowing triggering the release of powder only when necessary.

Advantageously, at least one detector may allow measuring a signal whose value is proportional to a concentration of the flammable gas. This signal is then compared to at least one threshold, and it is considered that the flammable gas is detected when the measured value exceeds a threshold. This may allow avoiding the release of powder in case of a very small leak. It is therefore possible to segregate between small leaks of flammable gas (e.g., less than 10 kg of flammable gas in the cloud) and large leaks of flammable gas (e.g., more than 50 kg of flammable gas in the cloud).

Alternatively, at least one detector device may allow measuring a Boolean signal, whose value equals zero for example as long as no flammable gas is detected, and 1 otherwise.

Advantageously, the method may comprise a plurality of detecting steps, each detecting step being followed by an associated activation.

For example, upon a first detecting step, during which a slight presence of the flammable gas is detected, an alarm may be activated such that the operators could leave the hazardous area.

Possibly, upon a second detecting step, during which the presence is confirmed (e.g. because higher concentrations are measured and/or because a higher number of detector devices have detected the presence of the flammable gas), a vessel containing the powder may be pressurized.

Upon a third detecting step, (or a second detecting step), the control signal may be generated and transmitted so as to release powder into the hazardous area.

There is also provided a computer program product comprising instructions to perform the steps of the method described hereinabove when executed by a processor. This program may be stored, downloaded, etc.

There is also provided a device to mitigate the consequences of a vapor cloud explosion due to an accidental release of a flammable gas in an open area, comprising:

- a memory to store an identifier of a hazardous area wherein an accidental release of flammable gas is likely to happen;
- reception means to receipt a plurality of signals from a plurality of detector devices, each detector device being able to detect the presence of the flammable gas within the hazardous area,
- processing means that are arranged so as to, if one or a number of detector devices, comprising at least two detector devices, detect(s) the presence of the flammable gas, generate a control signal to activate a release of a flame acceleration suppression product in the defined hazardous area, and
- transmitting means to transmit the control signal towards release means corresponding to the hazardous area.

This device may comprise or be integrated into one or several processors, e.g. microcontrollers, microprocessors, etc.

The reception means includes, for example, an output pin, or an entry port.

The processing means includes, for example, a central processing unit, or a processor.

The transmitting means includes, for example, an output pin, or an output port.

It is also provided a method to mitigate the consequences of a vapor cloud explosion due to an accidental release of a flammable gas in an open area, comprising:

- defining an hazardous area wherein an accidental release of flammable gas is likely to happen and possibly storing size data of this hazardous area;
- receiving a signal from a detector device able to detect the presence of the flammable gas within the hazardous area,
- upon reception of a signal indicating the presence of the flammable gas within the hazardous area, generating a control signal to activate a release of a flame acceleration suppression product in the hazardous area, at a rate that is determined as a function of the volume of the hazardous area and/or such that the quantity to be released is determined as a function of the volume of the hazardous area.

That is, one determines a release rate (and/or a quantity of powder to be released) within the hazardous area that depends on the volume of the hazardous area, so as to inhibit any cloud explosion within this area, thus allowing a safer mitigation than in prior art. This may be particularly interesting when the hazardous area is within a block of a plant, e.g., an oil refinery, because the scattering of the flammable gas within the block may be relatively difficult to predict. In particular, the flammable gas may follow preferential paths. By providing enough powder to occupy the whole hazardous area, the risk of having a non-inhibited cloud is reduced.

The control signal may be transmitted to release means corresponding to the entire hazardous area.

This method is therefore more reliable than a method that would consist in releasing powder only from the nozzle(s) that are close to the detector device(s) that has (have) detected the presence of inflammable gas.

The size data may for example comprise a value of a volume of the hazardous area, values of length, width and height, locations values of the ends of the hazardous area, and/or other. The invention is not limited to the nature of the size data as long as it allows calculating a volume value of the hazardous area.

The rate value may be determined such that a ratio between this rate value and the volume of the hazardous area equals a predetermined amount, e.g. between 1 and 4 $g \cdot s^{-1} \cdot m^{-3}$, advantageously between 1.6 and 2 $g \cdot s^{-1} \cdot m^{-3}$.

The rate and/or the quantity may be further determined as a function of a required duration of protection and/or of a target concentration of powder within the hazardous area.

Advantageously, the control signal may be generated such that the powder is released continuously during a single lapse of time, i.e., without interruptions.

The rate may vary during the release, or advantageously remain constant during the lapse of time of the release.

Advantageously, the rate and/or the quantity of flame acceleration suppression product to be released within the hazardous area may be determined such that during a predetermined period of time, which lasts for example 5 minutes, the concentration of the released acceleration suppression product within the hazardous area exceeds 50 $g/m^3$, advantageously 75 $g/m^3$, is advantageously close to or equal to 100 $g/m^3$, and is advantageously less than 500 $g/m^3$.

The quantity of the flame acceleration suppression product to be released within the hazardous area may be determined such that the release at the determined rate may last sufficiently long for such target concentration to be substantially achieved at least for 1 second. For example, when powder is released within a hazardous area of 5000 $m^3$ at a rate of 10 kg per second, during 50 seconds, the concentration of powder within the hazardous area may reach 100 $g/m^3$. One may therefore provide a quantity of at least 500 kg of powder in the vessels of the corresponding block.

It is advantageous that the flame acceleration suppression product remains airborne in the cloud as long as the risk of a VCE is possible. The ignition may for example occur from 30 seconds to 15 minutes after the beginning of the leakage.

Advantageously, the generated control signal may be such that the release takes place within more than 5 minutes, advantageously more than 7 minutes, advantageously more than 10 minutes, and advantageously more than 15 minutes.

The quantity of powder to be provided within the vessels of the block may thus be determined based on the determined rate and on an expected duration of the release. For example, for a 5 minutes release at a rate of 10 kg/s, one may provide 3000 kg of powder within the vessels.

Advantageously, once the rate is determined, one may choose the number of nozzles and skids to be installed per block, e.g., so as to optimize the kinetics of the dispersion of the flame acceleration suppression product in the block, and select the nozzles depending on the expected rate per nozzle.

For example, for a hazardous area having a volume of 5000 $m^3$, 4 skids and 4 corresponding nozzles may be provided, each skid being able to store between 750 kg and 1000 kg of powder. In case detection occurs, the control signal may be generated such that each nozzles releases powder at a rate between 2 and 2.5 kg/s during 300 seconds or more.

Advantageously, the quantity of flame acceleration suppression product to be released within the hazardous area and the duration of the lapse of time during which the release takes place are determined such that the concentration of the released acceleration suppression product within the hazardous area exceeds 50 $g/m^3$, advantageously 75 $g/m^3$, and is advantageously close to or equal to 100 $g/m^3$ (advantageously less than 500 $g/m^3$), for each cubic meter of the hazardous area and during a predetermined period of time, which lasts for example 5 or 10 minutes.

The period of time may for example start between 10 seconds and two minutes after the beginning of the releasing of powder, advantageously less than 1 minute after the beginning of the releasing.

Advantageously:

- the volume of the hazardous area may between 1000 and 20000 cubic meters, advantageously between 4000 and 6000 cubic meters, advantageously between 4500 and 5500 cubic meters, advantageously between 4800 and 5100 cubic meters,
- the flow rate of the release of powder within the whole hazardous area may vary from 1 kg/s to 30 kg/s, advantageously from 5 kg/s to 15 kg/s, advantageously from 8 kg/s to 10 kg/s,
- the quantity of flame acceleration suppression product to be released within the hazardous area varies from 100 to 20000 kg, advantageously from 2000 to 6000 kg, e.g. between 2500 kg and 4000 kg, and/or
- the duration of the lapse of time during which the release takes place varies between 3 minutes and 30 minutes, e.g. 15 minutes.

Advantageously, the release may be done continuously within the lapse of time. Advantageously, the release may be done at a same speed during the whole lapse of time, e.g. 500 kg/minute. In case four nozzles are provided, each nozzles releases powder at a speed of 125 kg/minute in this example.

In case four nozzles are provided, the flow rate per nozzle may have a value between 2 and 2.5 kg/s. This may be achieved with nozzles having a diameter between 8 and 11 mm.

Surprisingly, a continuous release is relatively efficient to sustain a powder cloud for a predetermined period of time, e.g. a 5 or 10 minutes period of time that starts substantially 1 minute after the beginning of the flammable gas release, at a target concentration, e.g. 100 $g/m^3$.

This period of time during which the target concentration should be sustained may have a duration between 30 seconds and 20 minutes, e.g. 5 minutes.

Advantageously, the release may be made such that the inhibitor particles cloud covers a relatively large volume, e.g., more than 1000 $m^3$ per injection skid, advantageously more than 1250 $m^3$ per injection skid.

Advantageously, the release may begin immediately after the detection of a reliable leak of flammable gas. Alternatively, the control signal may be generated to as to impose a temporary delay before the release of the inhibitor particles, e.g. a 10 seconds delay.

In an embodiment, the method further comprises transmitting a fire signal so as to trigger ignition of the cloud during the release of the inhibitor, e.g. soon before the end of the lapse of time during which the release is performed.

The fire signal may for example be generated such that ignition occurs during the release of inhibitor.

Alternatively, and advantageously, no signal is transmitted so as to trigger ignition of the cloud. One may simply wait that the cloud ignites by itself.

Advantageously, the method may further comprise:

- storing a model of flammable cloud dispersal beyond the hazardous area,
- upon receipt of the signal indicating the presence of the flammable gas within the hazardous area, generating an additional control signal to activate a release of some flame acceleration suppression product in an additional hazardous area that is determined as a function of the stored model.

That is, if flammable gas is detected at a block (i,j), a model, based on the environment, may be used so as to predict that gas is more likely to propagate to the blocks (i+1, j−1) and (i+1, j) for example. Therefore, powder is released also at the nozzles of theses blocks (i+1, j−1) and (i+1, j).

The additional area(s) wherein the flammable cloud is likely to scatter may advantageously be determined also as a function of other parameters, e.g. identifiers of the detector device(s) which have detected the flammable gas, parameters relating to the wind, etc.

There is also provided a computer program product comprising instructions to perform the steps of the method described hereinabove when executed by a processor. This program may be stored, downloaded, etc.

There is also provided a device to mitigate the consequences of a vapor cloud explosion due to an accidental release of a flammable gas in an open area, comprising:

- a memory to store an identifier of a hazardous area wherein an accidental release of flammable gas is likely to happen and possibly size data of this hazardous area;
- reception means to receipt a signal from a detector device able to detect the presence of the flammable gas within the hazardous area,
- processing means that are arranged to, upon reception of a signal indicating the presence of the flammable gas within the hazardous area, generate a control signal to activate a release of a flame acceleration suppression product at a rate (and/or a quantity) that is determined as a function of the volume of the hazardous area,
- transmitting means to transmit the control signal toward release means corresponding to said hazardous area.

This device may comprise or be integrated into one or several processors, e.g. microcontrollers, microprocessors, etc.

The reception means may comprise an output pin, an entry port, etc.

The processing means may comprise a central processing unit, a processor, etc. The processing means may be arranged to calculate a release rate and/or a quantity of flame acceleration suppression product to be released, and possibly a duration of a lapse of time during which the release may occur. Alternatively, these parameters relative to the release of powder may be determined by a human operator.

The transmitting means may comprise an output pin, an output port, etc.

There is also provided a system to mitigate the consequences of a vapor cloud explosion due to an accidental release of a flammable gas in an open area, comprising for each area that is defined as hazardous:

at least one set of two vessels comprising a first vessel for storing a flame acceleration suppression product and a second vessel for storing a carrier gas, and, for each set of two vessels:

at least two nozzles, a duct arranged to connect the first vessel to both nozzles.

That is, a same vessel for storing the powder is shared between two nozzles or more.

This system may further comprise one of the devices described herein above, or both.

Alternatively, one may provide one nozzle for each set of two vessels. For example, one may provide fours nozzles and four skids per block.

In a further embodiment, there may be provided three skids per block, each skid corresponding to a single nozzle.

Having a single nozzle per skid may be advantageous since the friction losses and the time for the powder to reach the nozzle may be reduced because of the reduced length of the pipes. This further allows a relatively good access for maintenance, and a relatively easy installation, because of the size of the skid.

One skid may contain for example between 750 kg and 1000 kg of powder.

There is also provided a system to mitigate the consequences of a vapor cloud explosion due to an accidental release of a flammable gas in an open area, comprising for each area that is defined as hazardous, at least one pair of nozzles that are placed oppositely such that the flame acceleration suppression product released by one of these nozzles is moved toward the other nozzle or lower, because of gravity. This arrangement may allow scattering powder until every corner of the hazardous area.

There is also provided a method and a system for mitigating the consequences of a vapor cloud explosion due to an accidental release of a flammable gas in an open area, wherein a flame acceleration suppression product comprising a mixture of at least two compounds selected from the group comprising potassium chloride, sodium chloride and potassium carbonate, is released into an hazardous area. Releasing simultaneously several compounds of this group allows improving the inhibition of the VCE. It has indeed been observed the efficiency for inhibiting VCE of each compound may vary with the concentration of flammable gas, potassium chloride being recommended at high concentrations and potassium carbonate at lower concentrations. This efficiency also depends on the nature of the flammable gas. Releasing a mixture of these compounds may thus allow having a correct inhibition over the whole volume of the hazardous area, on which the concentration of flammable gas is likely to change from one place to the other.

Each of the at least two compounds may be provided at a weight concentration higher or equal to 5%, preferably 10%, within the flame acceleration suppression product.

Advantageously, the powder may comprise additive(s) in order to avoid caking and additive(s) to improve fluidization properties.

Advantageously, most (e.g. 95% or more) of the particles of the flame acceleration suppression product may have a diameter varying between 1 μm and 100 μm, advantageously between 20 μm and 40 μm.

The particles may advantageously be porous. Open pores allow increasing the outside surface of the particles, and thus their chemical efficiency.

There is also provided an installation, e.g. an oil refinery, comprising a plurality of systems as described herein above.

Advantageously, each system is associated to a block for which a corresponding hazardous area has been defined.

The herein above described features may of course be combined.

Other features and advantages shall appear more clearly from the following description of a particular embodiment given by way of a simple, illustratory and non-exhaustive example and from the appended drawings, of which:

Figure 1:
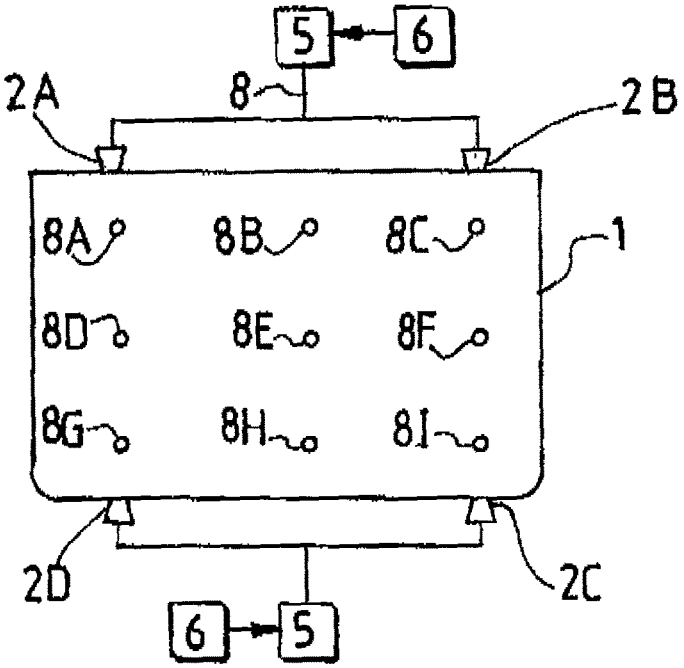
FIG. 1 and FIG. 2 are very schematic illustrations of an exemplary system according to an embodiment of the present invention.

Flammable gases are handled in many industrial applications, including utilities, chemical and petrochemical manufacturing plants, petroleum refineries, metallurgical industries, distilleries, paint and varnish manufacturing, marine operations, printing, semiconductor manufacturing, pharmaceutical manufacturing, and aerosol can filling operations, as a raw material, product or byproduct. In addition, combustible gases are released by leakage from above- or below-ground piping systems or spillage of flammable liquids. The invention is of high interest for the refineries and petrochemical plants.

An oil refinery may comprise a number of units.

The present invention may be applied for example to three units of an oil refinery, e.g., a steam cracker unit, a butadiene separation unit, an aromatics unit, etc.

Every unit has been divided into process zones. There may be for example between 1 and 4 process zones per unit.

Every process zone has been divided into blocks. Each block dimensions are within a predetermined range corresponding roughly to the lower limit for major VCE in naphtha cracker units [FABIG, D. Roosendans, London, Dec. 4, 2008] i.e., 5000 $m^3$. For example, each block may have a length of 40 meters, a width of 30 meters and a height varying between 3 and 12 meters for example 4 meters ($40*30*4=4800$ $m^3$).

The protection of each block of the units with such size may prevent any VCE with major impact on building, material and people.

For example, for the steam cracker unit, 4 zones have been defined:

A furnaces zone, which comprises 2 blocks;

A hot train zone, which comprises 5 blocks;

A cold train and compression zone, which comprises 4 blocks; and

A Separation section, which comprises 4 blocks.

For the butadiene separation unit, a single zone has been defined. This single zone comprises 3 blocks.

For the aromatics unit, 3 zones have been defined: a first zone with 4 blocks, a second zone with 2 blocks and a third zone with 2 blocks.

Figure 2:
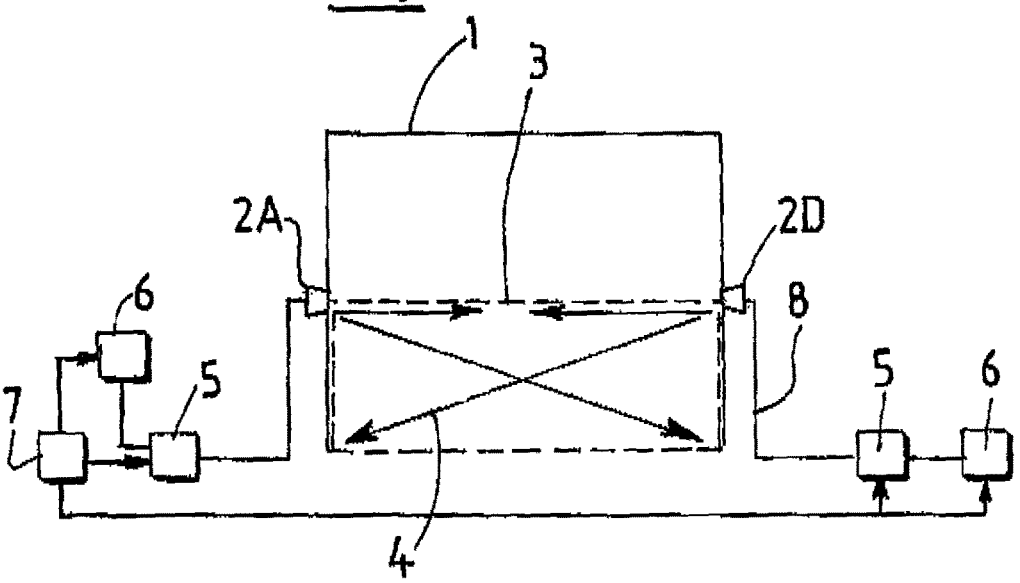

FIG. 1 is a top view of an exemplary block 1, and FIG. 2 is a side view of this exemplary block 1. Both views are very schematic.

Even if a single block is shown of FIG. 1 and FIG. 2 for the sake of simplicity, the skilled person will appreciate that an oil refinery comprises a number of blocks.

The block 1 comprises a number of equipment and pipes (not represented), some of them carrying flammables gases.

A flammable gas is any gas or vapor that can deflagrate in response to an ignition source when the flammable gas is present in sufficient concentrations by volume with oxygen. Deflagration is typically caused by the negative heat of formation of the flammable gas. Flammable gases generally deflagrate at concentrations above the lower explosive limit and below the upper explosive limit of the flammable gas. In a deflagration, the combustion of a flammable gas, or other flammable substance, initiates a chemical reaction that propagates outwards by transferring heat and/or free radicals to adjacent molecules of the flammable gas.

A volume 3 is defined as a hazardous area. Its length and width may be equal to the length and width of the block, e.g., 40 meters and 30 meters respectively. The height of the volume may be of 4 meters for example. It is considered that at higher heights, the congestion by equipment and pipes is lower (lower risk of VCE) and the flammable gas is dispersed by the wind.

Each block, and/or each volume 3, is protected by two pairs of nozzles 2A, 2B, 2C, 2D on each side in opposite, i.e., by a total of 4 nozzles. Each nozzle allows releasing powder into the block 1. The nozzles are placed at a height that equals the height of the hazardous area, e.g., 4 meters.

The powder is a flame acceleration suppression product that acts as an inhibitor when released into a flammable gas cloud.

The main action of the inhibitor is to capture chain carriers such that a chain branching rate is lowered. There will also be additional physical actions (such as cooling and adsorption) which could lower the reaction rates.

After release, the flame acceleration suppression product not only dilutes the oxygen available for the combustion of the flammable gas but also impairs the ability of free radicals to propagate the deflagration.

While the method of the invention can be employed to suppress deflagrations associated with flammable gases, the method is particularly applicable to suppressing deflagrations of flammable gases having combustion temperatures ranging from about 500° C. to about 2500° C.

Such flammable gases may for example include ethylene, propylene, propane but also benzene, ether, methane, ethane, hydrogen, butane, propane, carbon monoxide, heptane, formaldehyde, acetylene, ethylene, hydrazine, acetone, carbon disulfide, ethyl acetate, hexane, methyl alcohol, methyl ethyl ketone, octane, pentane, toluene, xylene, and mixtures and isomers thereof.

The flame acceleration suppression product may be any product which captures the free radicals and as such limits the branching reactions. Advantageously, the powder may comprise additive(s) in order to avoid caking and additive(s) to improve fluidization properties.

The result is that the flame acceleration is altered and that a devastating explosion is mitigated. The flammable gas will burn more slowly and not develop in a devastating explosion in case of an ignition. The flame acceleration suppression product should not create any risk (e.g. toxic) for humans or the environment.

The flame acceleration suppression product can be a gas, a liquid or a solid (advantageously in a powder form and preferably in a dry powder form).

The flame acceleration suppression product may be a metal compound such as, by way of example, a salt. Several products (salts) and mixtures have been tested. The aim of the flame acceleration suppression mixture is to allow capture of different type of radicals.

By way of example of flame acceleration suppression products, one can cite sodium bicarbonate ($NaHCO_3$), potassium bicarbonate ($KHCO_3$), sodium chloride and sodium carbonate. The flame acceleration suppression product can be mixed with primary anti-oxidants and/or secondary anti-oxidants.

Most (e.g., 90% or more) of the particles of the flame acceleration suppression product may have a diameter varying between 20 μm and 40 μm, in particular when the product comprises essentially sodium bicarbonate.

Arranging the nozzles in opposite, i.e., the nozzle 2A facing the nozzle 2D and the nozzle 2B facing the nozzle 2C, allows scattering the powder within the whole defined volume. As represented by the arrows 4 on FIG. 2, the released powder moves into the whole volume, or at least into a large part of this hazardous area (e.g. more than 80% of its volume). Providing nozzles on both sides of the block 1 may thus allow reaching a desired concentration of powder:

in all the width of the hazardous area.

in a shorter time (it is advantageous to establish as fast as possible the cloud of inhibitor with the right concentration after the gas release).

Advantageously, the acceleration suppression product may be dispersed in the area by a carrier gas, e.g. nitrogen, originally contained in a vessel 6.

The vessels 5 contain the flame acceleration suppression product.

The system further comprises valves (not represented) arranged on the ducts 8 between the vessels 5 and the nozzles 2A, 2B, 2C, 2D.

Processing means, e.g., a processor 7 within a control room, are in electrical communication with detector devices 8A, . . . , 8I arranged within the block 1, and with the vessels 5,6. The processor 7 is arranged to generate a control signal when 2 or 3 detectors devices are activated together, and to transmit the generated control signal to the vessels 5, 6 so as to release the powder via the four nozzles 2A, 2B, 2C and 2D of the block together.

As can be seen from FIG. 1, there is provided a single vessel for the powder 5 and a single vessel for the carrier gas 6 for a couple of nozzles 2A, 2B, or 2C, 2D. The ducts 8 are arranged to connect each vessel for the powder 5 to two nozzles 2A, 2B, or 2C, 2D.

This arrangement is advantageous as compared to an arrangement with a vessel 5 and a vessel 6 per nozzle, because it allows saving one vessel for the flame acceleration suppression product and one vessel for the carrier gas per couple of nozzles. The skilled person would not have combined the vessels 5, 6 with a couple of nozzles because one would have expected the flame acceleration suppression product to plug within a duct having a longer path for the product from the vessel 5 to the nozzle or to be dispersed without the same flow rate on the different nozzles. Surprisingly, it did not. In particular, the length of the path from the vessel 5 to the nozzle may reach 10 meters, or even more.

In an alternative embodiment, a third nozzle may be provided on this duct 8, at a middle position between the nozzles 2A, 2B, or 2C, 2D fed by a same vessel. However, having two nozzles only per vessel 5 is advantageous because the pressure at the nozzles 2A (or 2C) is close to the pressure at the nozzle 2B (or 2D), as long as these nozzles are arranged relatively symmetrically. That is, the particle speed at the nozzles 2A and 2B, or 2C and 2D, may be substantially similar, thus allowing a better (homogeneous) scattering of the hazardous area.

Each nozzle may define a simple hole having a diameter of 10-11 mm.

The detector devices 8A, . . . 8I may for example comprise infrared detectors.

As can be seen on FIG. 1, a plurality of infrared detectors, e.g. 9 infrared detectors 8A, . . . 8I are arranged within the block 1 or around the block 1, preferably within the hazardous area 3 of the block 1.

Figure 3:
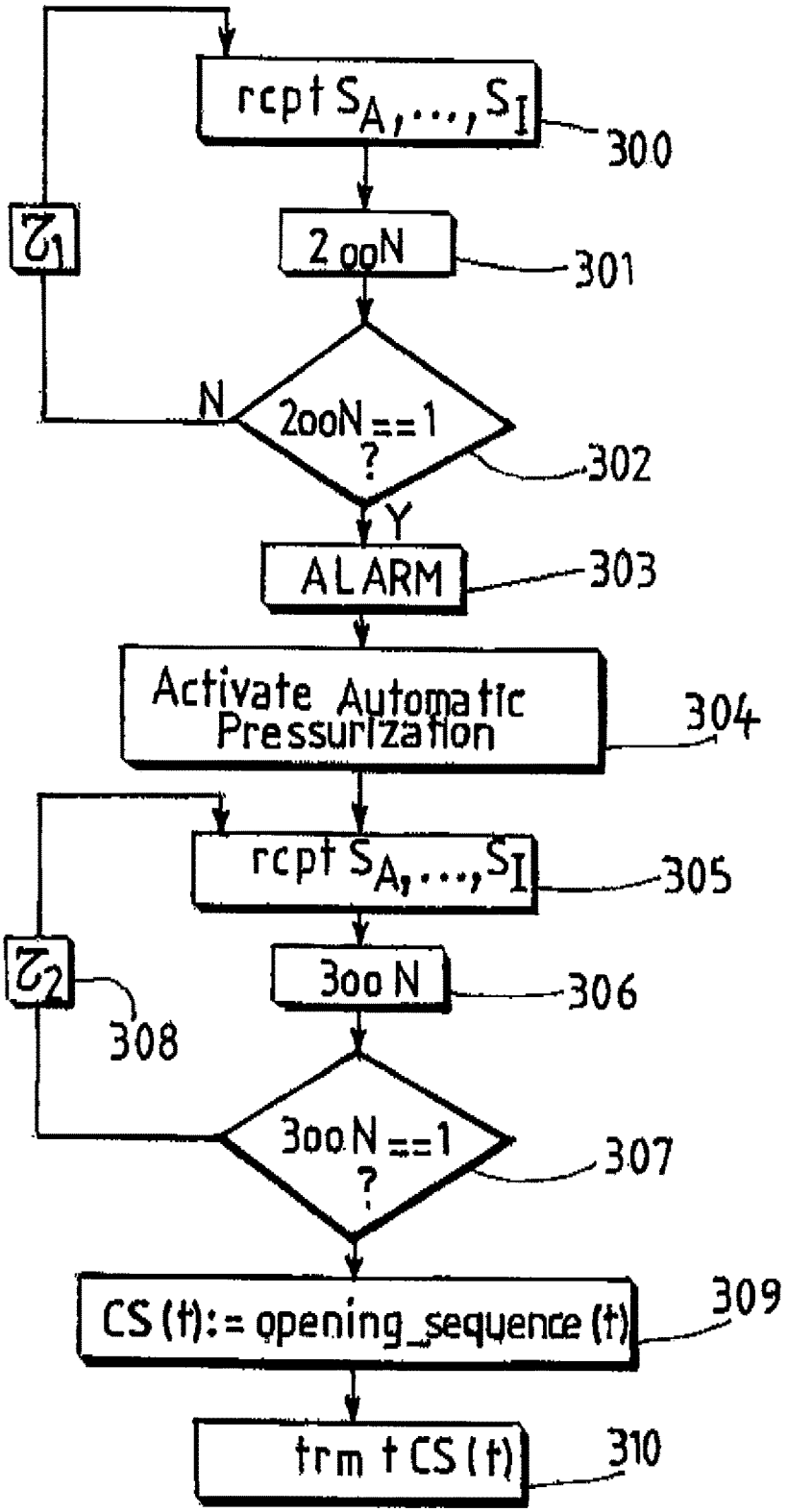
FIG. 3 represents, in a flow diagram form, the main steps of an exemplary method according to an embodiment of the present invention.

Now referring to FIG. 3, the illustrated flow diagram corresponds to a method executed by the processor 7 of the control room of the inhibition system.

On reception of signals $S_A$, . . . , $S_I$ originating from the respective gas detectors 8A, . . . , 8I (step 300), the processor compares each received signal to a first threshold THR1. These comparison steps are not illustrated on FIG. 3. The first threshold equals 20% of a predetermined low flammable limit (LFL) value.

This LFL value corresponds to a concentration of flammable gas within the air corresponding to the stoichiometric proportions of the reaction between the flammable gas and air.

If two side detectors, e.g., the detectors 8A and 8B, or 8A and 8E, or 8D and 8G, have measured signals that exceed the first threshold THR1, a first detection Boolean variable 2ooN is set to 1.

Otherwise, the Boolean 2ooN is maintained to a zero value. For example, if the detectors 8A, 8C, 8I have measured signals that exceed the first threshold THR1 and if the other detectors 8B, 8D, 8E, 8F, 8G and 8H have measured signals that are below the first threshold, the variable 2ooN equals zero.

The generating of this variable 2ooN is represented by step 301 on FIG. 3.

If the variable 2ooN equals 1 (test 302), then an alarm is activated (step 303). More precisely, during the step 303, the processor generates signals that are transmitted to an alarm system (not represented on FIG. 1). For example, activating an audible alarm and a visual alarm may allow evacuating the concerned block.

Further, automatic pressurization is activated for the two powder skids pairs of every block whose each detector having measured a signal above the first threshold depend (step 304).

Again, during the step 304, the processor generates signals that are transmitted to a valve, such that nitrogen cylinders 6 pressurize the corresponding powder drum storages 5.

New values of the signals $S_A$, . . . , $S_I$ measured by the detectors 8A, . . . 8I are received during a step 305.

Then, at step 306, the processor determines the value of a second detection Boolean variable 3ooN.

The processor compares each received signal to a second threshold THR2. These comparison steps are not illustrated on FIG. 3. The second threshold equals 80% of the LFL value.

If three side detectors, e.g. the detectors 8A, 8B and 8F, or 8A, 8E and 8I, or 8D, 8E and 8F, have measured signals that exceed the second threshold THR2, the second detection Boolean variable 3ooN is set to 1.

Typically, with leak rates between 5 kg/s and 50 kg/s, it takes around 10 seconds before the variable 3ooN is set to 1.

Otherwise, the Boolean 3ooN is maintained to a zero value. For example, if the detectors 8A, 8B, 8I have measured signals that exceed the second threshold THR2 and if the other detectors 8C, 8D, 8E, 8F, 8G and 8H have measured signals that are below the second threshold, the variable 3ooN equals zero.

If the variable 3ooN equals 1 (test 307), then an alarm is activated (step not represented). Otherwise, the processor waits for a determined lapse of time (step 308), e.g. 1 second, before receiving new values from the detectors (step 305) and repeating the steps 306, 307.

If the test 307 is positive, and if the pressure in the powder drum reaches a predetermined threshold, e.g., 16 barg, (this test not being represented), the processor generates a control signal CS(t) to activate a release of a flame acceleration suppression product in the hazardous area (step 309). This signal CS(t) is then transmitted toward a valve so as to control the release of powder (step 310).

Once the variable 3ooN is set to 1, it may take 2 seconds for example before the action is launched. Then, it may take around 30 seconds for the powder cloud to be established.

For example, the CS(t) signal may be generated to as to control the following sequence, during which powder is discharged several times at regular interval:

A discharge valve stays open during 5 seconds.

Then the valve is closed for 15 seconds.

The valve is opened again for 5 seconds and so on, 15 times in succession, for a protection of 5 minutes.

Alternatively, the control signal may simply allow opening the valve so as to release powder during predetermined lapse of time, e.g., 300 seconds, without any complete or partial closure of the valve during this lapse of time.

Surprisingly, releasing continuously the powder allows a better reduction of the vapor cloud explosion effects.

The nozzles are directed substantially horizontally, at an elevation of about 4 meters, so as to allow the cloud of released powder to spread at the first 4 meters level of the block.

Having a threshold corresponding to 80% of the LFL value to open the powder discharge allows insuring that the mass of flammable gas inside the cloud is sufficient for a strong explosion to be very likely. The release will not be triggered for a quantity of hydrocarbon that is too small for a VCE, e.g. less than 50 kg.

The invention is by no means limited to the use of two threshold values THR1, THR2 being equal to 20% and 80% of the LFL value. For example, one could use three threshold values, corresponding to 20%, 40% and 80% of the LFL value. When two detectors measure a concentration of flammable gas that exceeds 20% of the LFL value, an alarm is activated. When two or three detectors measure a concentration of flammable gas that exceed 40% of the LFL value, automatic pressurization is activated for the two powder skids. When three detectors measure a concentration of flammable gas that exceeds 80% of the LFL value, the powder is released into the block.

Alternatively, when one detector measures a concentration of flammable gas that exceeds 20% of the LFL value, an alarm is activated. When two detectors measure a concentration of flammable gas that exceeds 20% of the LFL value, automatic pressurization is activated for the two powder skids. This pressurization thus allows saving time since the vessel should be at the proper pressure when the 3ooN variable is set to 1.

When three detectors measure a concentration of flammable gas that exceeds 80% of the LFL value, the powder is released into the block.

These methods, based on the monitoring of a plurality of detectors and on an initiating only after several side detectors have measured a determined concentration of flammable gas, may allow the release of the powder to take place only for possibly dangerous flammable clouds and soon enough for the ignition result in a burning of the flammable gas without explosion.

The invention claimed is:

1. A device to mitigate consequences of a vapor cloud explosion due to an accidental release of a flammable gas in an open area, comprising:

a memory to store an identifier of a hazardous area wherein an accidental release of flammable gas is likely to happen;

an output pin or an entry port to receive a signal from a detector device able to detect presence of the flammable gas within the hazardous area;

a central processing unit or a processor that are arranged to, upon reception of a signal indicating the presence of the flammable gas within the hazardous area, generate a control signal and activate a release of a flame acceleration suppression product in the hazardous area, at a rate that is determined as a function of a volume of said hazardous area, wherein the rate of the flame acceleration suppression product varies from 5 to 15 kg/s, and a ratio between the rate of the flame acceleration suppression product and the volume of the hazardous area equals a predetermined amount between 1 and 4 $g \cdot s^{-1} \cdot m^{-3}$ (every cubic meter with a rate of gram per second); and an output pin or an output port to transmit the control signal toward at least one nozzle connected to a vessel.

2. A method to mitigate the consequences of a vapor cloud explosion due to an accidental release of a flammable gas in an open area, comprising providing a device according to claim 1 and using said device:

storing an identifier of a hazardous area wherein an accidental release of flammable gas is likely to happen;

receiving a signal from the detector device able to detect the presence of the flammable gas within the hazardous area;

upon reception of a signal indicating the presence of the flammable gas within the hazardous area, generating the control signal and activate a release of the flame acceleration suppression product in the hazardous area, at a rate that is determined as a function of a volume of said hazardous area, wherein the rate of the flame acceleration suppression product varies from 5 to 15 kg/s, and a ratio between the rate of the flame acceleration suppression product and the volume of the hazardous area equals a predetermined amount between 1 and 4 $g \cdot s^{-1} \cdot m^{-3}$ (every cubic meter with a rate of gram per second).

3. The method according to claim 2, wherein the volume of the hazardous area varies from 4500 to 5500 $m^3$.

4. The method according to claim 2, comprising generating the control signal such that the release of the flame acceleration suppression product takes place for more than 5 minutes.

5. The method according to claim 2, wherein the release of the quantity of flame acceleration suppression product is performed continuously within a determined lapse of time.

6. The method according to claim 2, wherein the control signal to activate a release of a flame acceleration suppression product in the defined hazardous area is generated only if a number of detector devices, comprising at least two detector devices, detect the presence of the flammable gas within the hazardous area.

7. The method according to claim 6, wherein the control signal is generated only if at least two adjacent detector devices detect the presence of the flammable gas.

8. The method according to claim 2, comprising on reception on a signal indicating a slight presence of the flammable gas within the hazardous area, activating an alarm.

9. The method according to claim 8, further comprising on reception of a signal confirming the presence of the flammable gas within the hazardous area, generating a signal so as to activate pressurization of a vessel containing the flame acceleration suppression product.

10. The method according to claim 2, further comprising storing a model of flammable cloud dispersal beyond the hazardous area, upon receipt of the signal indicating the presence of the flammable gas within the hazardous area, generating an additional control signal to activate a release of some flame acceleration suppression product in an additional hazardous area that is determined as a function of the stored model.

11. The method according to claim 2, further comprising providing a computer program product comprising instructions to perform the steps of claim 1, and executing said steps with a processor.

12. A system to mitigate consequences of a vapor cloud explosion due to an accidental release of a flammable gas in an open area, comprising a device as recited in claim 1, at least one set of two vessels comprising a first vessel for storing a flame acceleration suppression product and a second vessel for storing a carrier gas, and, for each set of two vessels:

at least one nozzle, a duct arranged to connect the first vessel to said at least one nozzle.

13. The system according to claim 12, wherein at least one set of the at least one set of two vessels comprises, at least two nozzles, and wherein the corresponding duct is arranged to connect the first vessel of said set to both nozzles.

14. The system according to claim 12, wherein at least two nozzles are provided, and wherein two nozzles among said at least two nozzles are placed oppositely such that the flame acceleration suppression product released by one of the two nozzles placed oppositely is moved towards the other nozzle or lower, because of gravity.

15. The system according to claim 12, wherein the flame acceleration suppression product comprises a mixture of at least two compounds selected form the group consisting of potassium chloride, sodium chloride and potassium carbonate.

16. An installation comprising a plurality of systems according to claim 12, each system being associated to a block for which a corresponding hazardous area has been defined.

17. A system to mitigate consequences of a vapor cloud explosion due to an accidental release of a flammable gas in an open area, comprising a device, at least one set of two vessels comprising a first vessel for storing a flame acceleration suppression product and a second vessel for storing a carrier gas, and, for each set of two vessels:

at least one nozzle, a duct arranged to connect the first vessel to said at least one nozzle, wherein the device comprises:

a memory to store an identifier of a hazardous area wherein an accidental release of flammable gas is likely to happen;

an output pin or an entry port to receive a signal from a detector device able to detect presence of the flammable gas within the hazardous area;

a central processing unit or a processor that are arranged to, upon reception of a signal indicating the presence of the flammable gas within the hazardous area, generate a control signal and activate a release of a flame acceleration suppression product in the hazardous area, at a rate that is determined as a function of a volume of said hazardous area, wherein the rate of the flame acceleration suppression product varies from 5 to 15 kg/s, and a ratio between the rate of the flame acceleration suppression product and the volume of the hazardous area equals a predetermined amount between 1 and 4 $g \cdot s^{-1} \cdot m^{-3}$ (every cubic meter with a rate of gram per second); and an output pin or an output port to transmit the control signal toward at least one nozzle connected to a vessel, wherein the flame acceleration suppression product comprises a mixture of at least two compounds selected form the group consisting of potassium chloride, sodium chloride and potassium carbonate.

* * * * *